US011946662B2

(12) United States Patent
Choi et al.

(10) Patent No.: US 11,946,662 B2
(45) Date of Patent: Apr. 2, 2024

(54) APPARATUS AND METHOD FOR PREDICTING AMOUNT OF TEMPERATURE CHANGE OF TARGET ZONE

(71) Applicant: SEEDN CO., LTD, Seoul (KR)

(72) Inventors: Hyun Woong Choi, Seongnam-si (KR); Won Jin Hong, Gwangju-si (KR)

(73) Assignee: SEEDN CO., LTD, Seoul (KR)

( * ) Notice: Subject to any disclaimer, the term of this patent is extended or adjusted under 35 U.S.C. 154(b) by 0 days.

(21) Appl. No.: 18/312,907

(22) Filed: May 5, 2023

(65) Prior Publication Data

US 2024/0027089 A1 Jan. 25, 2024

(30) Foreign Application Priority Data

Jul. 19, 2022 (KR) ..... 10-2022-0089021
Oct. 17, 2022 (KR) ..... 10-2022-0132972

(51) Int. Cl.

| | |
|---|---|
| ***F24F 11/62*** | (2018.01) |
| *F24F 120/12* | (2018.01) |
| *F24F 130/10* | (2018.01) |
| *F24F 130/20* | (2018.01) |

(52) U.S. Cl.

CPC ..... *F24F 11/62* (2018.01); *F24F 2120/12* (2018.01); *F24F 2130/10* (2018.01); *F24F 2130/20* (2018.01)

(58) Field of Classification Search

CPC ..... F24F 11/62
See application file for complete search history.

(56) References Cited

U.S. PATENT DOCUMENTS

2013/0066585 A1* 3/2013 Saito ..... F24F 11/30 702/134
2019/0017721 A1* 1/2019 Motodani ..... F24F 11/64

FOREIGN PATENT DOCUMENTS

KR 10-1598979 B1 3/2016
KR 10-2018-0066300 A 6/2018
KR 10-1908311 B1 10/2018

* cited by examiner

*Primary Examiner* — Mark A Connolly
(74) *Attorney, Agent, or Firm* — United One Law Group LLC; Kongsik Kim; Jhongwoo Peck

(57) ABSTRACT

An apparatus and a method for predicting an amount of temperature change of a target zone are provided. The method includes collecting a plurality of base information, and calculating base relationship information between an indoor/outdoor temperature difference of the target zone and an amount of temperature change of the target zone on the basis of the plurality of base information. Each of the plurality of base information is information on the amount of temperature change of the target zone according to the indoor/outdoor temperature difference of the target zone during a late night time section, and the late night time section is set on the basis of at least one of activity schedule information, a sunrise time point, and a sunset time point of the target zone.

12 Claims, 8 Drawing Sheets

APPARATUS AND METHOD FOR PREDICTING AMOUNT OF TEMPERATURE CHANGE OF TARGET ZONE

CROSS-REFERENCE TO RELATED APPLICATIONS

This application claims priority from Korean Patent Applications No. 10-2022-0089021 filed on Jul. 19, 2022, and No. 10-2022-0132972 filed on Oct. 17, 2022. The aforementioned applications are incorporated herein by reference in their entireties.

BACKGROUND

1. Technical Field

Exemplary embodiments of the present invention relate to an apparatus and a method for predicting an amount of temperature change of a target zone used for controlling driving of an air conditioner installed in the target zone.

2. Background Art

A cooling and heating device (or air conditioner) is a device that uses a cooling cycle to keep an indoor temperature comfortable for a person. The air conditioner inhales the hot air in the room, cool the room by discharging the heat with a low temperature refrigerant to the room, or then heat the room by the opposite action.

In general, driving the air conditioner is controlled by a direct manipulation of the person. For example, in summer, when the indoor temperature is high, a user turns on the air conditioner, and sets a desired temperature of the turned-on air conditioner to be low in order to reduce a high indoor temperature quickly.

On the other hand, many users are located in spaces such as restaurants, cafes, and offices, and generally, a manager of the space directly controls the driving of the air conditioner. However, there is a problem that the air conditioner cannot be efficiently driven due to the ignorance or indifference of the manager.

For example, in the summer, when the manager sets the desired temperature of the air conditioner to be high, the users can feel the heat, and the user may feel the cold when the manager sets the desired temperature of the air conditioner to be low. As a result, the users feel uncomfortable. Moreover, when the desired temperature of the air conditioner is set to be low in the summer, the power consumption of the air conditioner is increased, and as a result, there is a problem in that electricity cost of the space increases.

Therefore, the technology is required for the manager to efficiently drive the air conditioner without directly manipulating the air conditioner.

SUMMARY

An object of the present invention is to provide an apparatus and a method for predicting an amount of temperature change, which accurately predict the amount of temperature change of a target zone in order to minimize power consumption of an air conditioner by preventing unnecessary driving of the air conditioner.

Further, an object of the present invention is to provide an apparatus and a method for predicting an amount of temperature change, which calculate base relationship information of the target zone used to predict the amount of temperature change of the target zone.

The objects of the present invention are not limited to the above-mentioned objects, and other objects and advantages of the present invention that are not mentioned can be understood by the following description, and will be more clearly understood by exemplary embodiments of the present invention. Further, it will be readily appreciated that the objects and advantages of the present invention can be realized by means and combinations shown in the claims.

According to an exemplary embodiment of the present invention, a method for predicting an amount of temperature change of a target zone includes: collecting a plurality of base information; and calculating base relationship information between an indoor/outdoor temperature difference of the target zone and an amount of temperature change of the target zone on the basis of the plurality of base information, and each of the plurality of base information is information on the amount of temperature change of the target zone according to the indoor/outdoor temperature difference of the target zone during a late night time section, and the late night time section is set on the basis of at least one of activity schedule information, a sunrise time point, and a sunset time point of the target zone.

According to another exemplary embodiment of the present invention, an apparatus for predicting an amount of temperature change of a target zone includes: a memory storing a computer-readable instruction; and a processor implemented to execute the instruction, and the processor collects a plurality of base information, and calculates base relationship information between an indoor/outdoor temperature difference of a target zone and an amount of temperature change of the target zone on the basis of the plurality of base information, each of the plurality of base information is information on the amount of temperature change of the target zone according to the indoor/outdoor temperature difference of the target zone during a late night time section, and the late night time section is set on the basis of at least one of activity schedule information, a sunrise time point, and a sunset time point of the target zone.

According to the present invention, by accurately predicting the amount of temperature change of the target zone on the basis of the information of the amount of temperature change of the target zone according to an indoor and outdoor temperature difference in the target zone collected in a late night time section, the unnecessary driving of the air conditioner can be prevented, and the power consumption of the air conditioner can be minimized.

Further, according to the present invention, base relationship information between the indoor and outdoor temperature difference in the target zone and the amount of temperature change of the target zone to which a base thermal feature parameter is applied is calculated, so the amount of temperature change of the target zone can be accurately predicted by reflecting a unique thermal feature of the target zone.

In addition, the effect of the present invention is not limited to the above effects, and should be understood to include all the effects that can be inferred from the configuration of the present invention described in the detailed description or the claim of the present invention.

DETAILED DESCRIPTION

Figure 1:
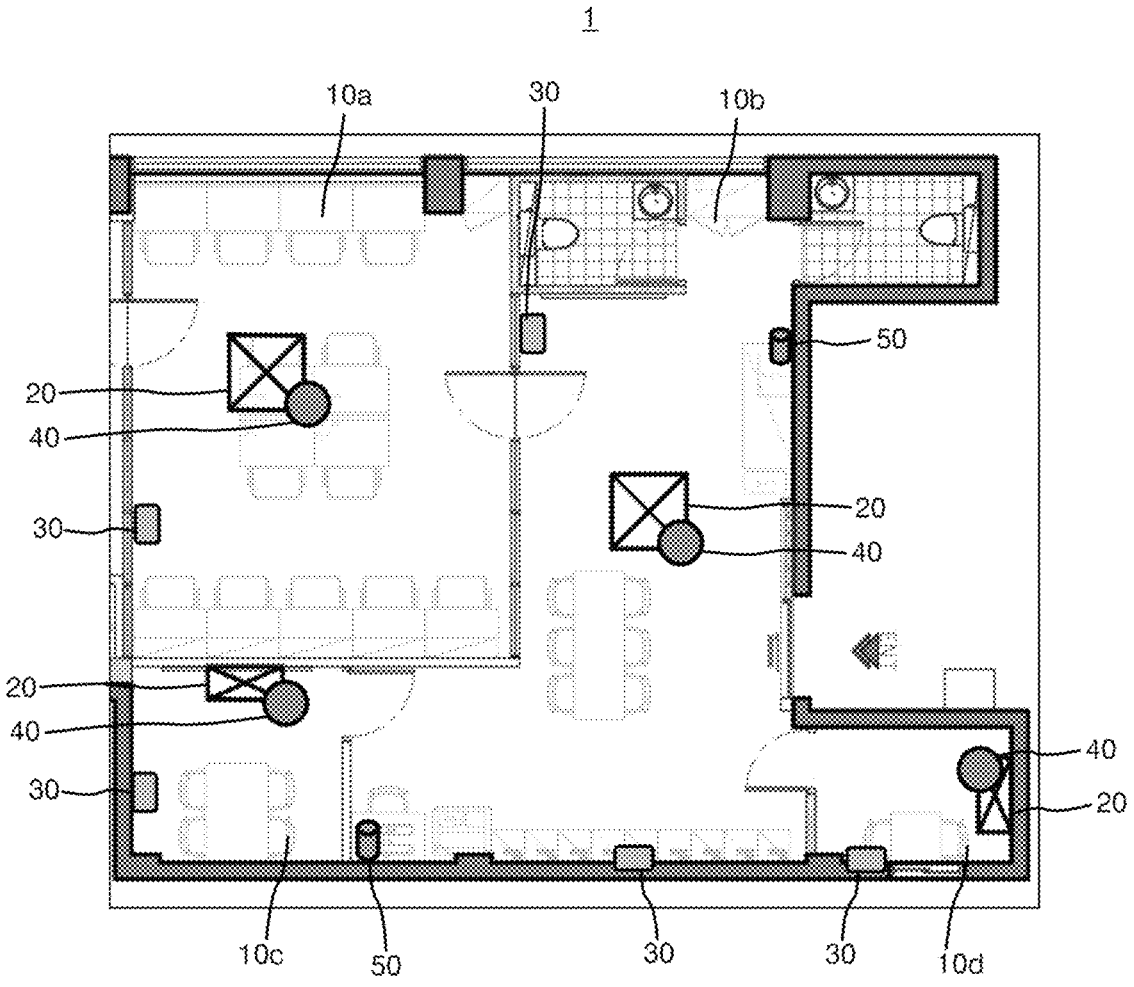
FIG. 1 is a diagram illustrating a schematic configuration of a space according to an exemplary embodiment of the present invention.

The present invention may be variously modified and have several embodiments, and thus, specific embodiments will be illustrated in the accompanying drawings and be described in detail. However, it is to be understood that the present invention is not limited to a specific exemplary embodiment, but includes all modifications, equivalents, and substitutions included in the scope and spirit of the present invention. In describing each drawing, similar reference numerals are used for similar components.

The terms such as "first," "second," or the like, may be used to describe various components, but these components are not to be construed as being limited to these terms. The terms are used only to distinguish one component from another component. The term "and/or" includes a combination of a plurality of related described items or any one of the plurality of related described items.

The terms used in the present specification are used only to describe specific embodiments rather than limiting the present invention. Singular forms are intended to include plural forms unless the context clearly indicates otherwise. It is to be understood that the term "include" or "have" used herein specifies the presence of features, numbers, steps, operations, components, parts, or combinations thereof mentioned in the present specification, or combinations thereof, but does not preclude the presence or addition of one or more other features, numbers, steps, operations, components, parts, or combinations thereof.

Hereinafter, exemplary embodiments of the present invention will be described in detail with reference to the accompanying drawings.

FIG. 1 is a diagram illustrating a schematic configuration of a space 1 according to an exemplary embodiment of the present invention.

Referring to FIG. 1, the space 1 includes a plurality of zones 10*a*, 10*b*, 10*c*, and 10*d*. The plurality of zones 10*a*, 10*b*, 10*c*, and 10*d* may be distinguished by an inner wall. The plurality of zones 10*a*, 10*b*, 10*c*, and 10*d* may be divided by the inner wall and may have different indoor temperatures and humidities.

An air conditioner 20, a temperature/humidity sensor 30, and a control module 40 may be installed in each of the plurality of zones 10*a*, 10*b*, 10*c*, and 10*d*. Further, a gateway 50 may be installed in at least a partial zone 10*b* of the plurality of zones 10*a*, 10*b*, 10*c*, and 10*d*. Meanwhile, although not illustrated in FIG. 1, an access point 60 (see FIG. 2) may be further installed in a specific zone among the plurality of zones 10*a*, 10*b*, 10*c*, and 10*d*.

Hereinafter, the present invention will be described by assuming the zone 10*b* in which the gateway 50 is installed as the target zone 10. However, the present invention is not limited thereto, and contents of the present invention to be described below may be applied to all of the plurality of zones 10*a*, 10*b*, 10*c*, and 10*d*.

Figure 2:
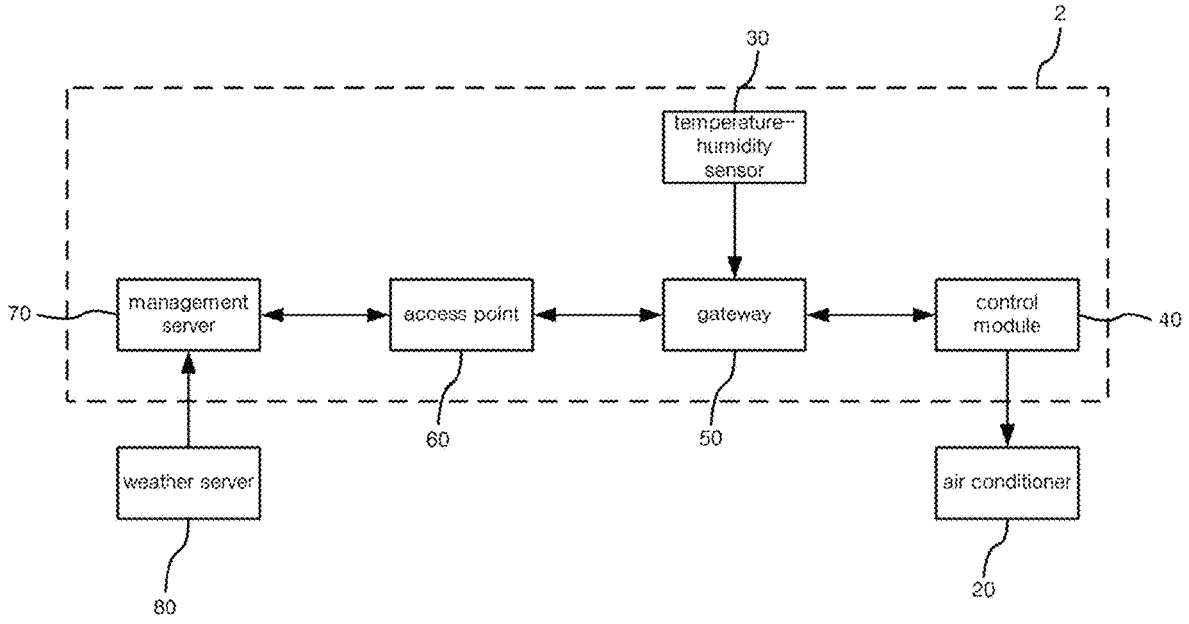
FIG. 2 is a diagram illustrating a schematic configuration of an air conditioner control system according to an exemplary embodiment of the present invention.

FIG. 2 is a diagram illustrating a schematic configuration of an air conditioner control system 2 according to an exemplary embodiment of the present invention.

Referring to FIG. 2, the air conditioner control system 2 includes a temperature/humidity sensor 30, a control module 40, a gateway 50, an access point 60, and a management server 70.

The temperature/humidity sensor 30 may measure the indoor temperature and humidity of the target zone 10. To this end, the temperature/humidity sensor 30 may include a temperature sensor module and a humidity sensor module.

The temperature/humidity sensor 30 may be installed in a location where the temperature and humidity of a zone where a person is primarily active, but is not limited thereto, and the temperature/humidity sensor 30 may also be built in the air conditioner 20.

The temperature/humidity sensor 30 may perform communication with another electronic device in the target zone 10. To this end, the temperature/humidity sensor 30 may include a short-range communication module. As an example, the temperature/humidity sensor 30 may include a Bluetooth communication module, but the present invention is not limited thereto.

The control module 40 may be a device transmitting a driving control signal for controlling the driving of the air conditioner 20 to the air conditioner 20. The control module 40 may be installed in a specific part of the target zone 10 adjacent to the air conditioner 20. As described later, the driving control signal may be generated by the management server 70 and transmitted from the management server 70 to the control module 40 through the access point 60 and the gateway 50.

To this end, the control module 40 may include a short-range communication module and an infrared data association (IrDA) module. For example, the control module may have a Bluetooth communication module, but the present invention is not limited thereto.

The gateway 50 may communicate with each of the temperature/humidity sensor 30, the control module 40, and the access point 60. To this end, the gateway 50 may include a first short-range communication module for communication connection with the temperature/humidity sensor 30 and the control module 40, and a second short-range communication module for communication connection with the access point 60. For example, the first short-range communication module may be the Bluetooth communication module, and the second short-range communication module may be a Wireless Fidelity (WiFi) communication module, but the present invention is not limited thereto.

The gateway 50 may receive indoor temperature and humidity information from the temperature/humidity sensor 30, and then transmit the indoor temperature/humidity information to the access point 60. In addition, the gateway 50 may receive the driving control signal of the air conditioner 20 to be described later from the access point 60, and then transmit the driving control signal to the control module 40. In addition, the gateway 50 may also receive driving-related data of the air conditioner 20 from the control module 40.

The access point 60 may relay communication between the gateway 50 and the management server 70. To this end, the access point 60 may include the second short-range communication module and a long-range communication module.

The management server 70 may be a device for actually controlling the air conditioner 20. The management server 70 may be communication connected with the access point 60 and a weather server 80. The management server 70 may receive the indoor temperature and humidity information of the target zone 10 from the access point 60, and receive weather information of the target zone 10 from the weather server 80. The management server 70 may generate the driving control signal of the air conditioner 20 using the indoor temperature and humidity information and the weather information of the target zone 10, and transmit the driving control signal to the access point 60.

The weather server 80 may be a server that provides the weather information for each administrative district. The weather information may be predicted information. The weather information may include an outdoor temperature, a cloud quantity, a precipitation probability, and a humidity. Meanwhile, the cloud quantity may correspond to a solar radiation (i.e., the amount of sunlight).

Hereinafter, the management server 70 will be described in more detail.

Figure 3:
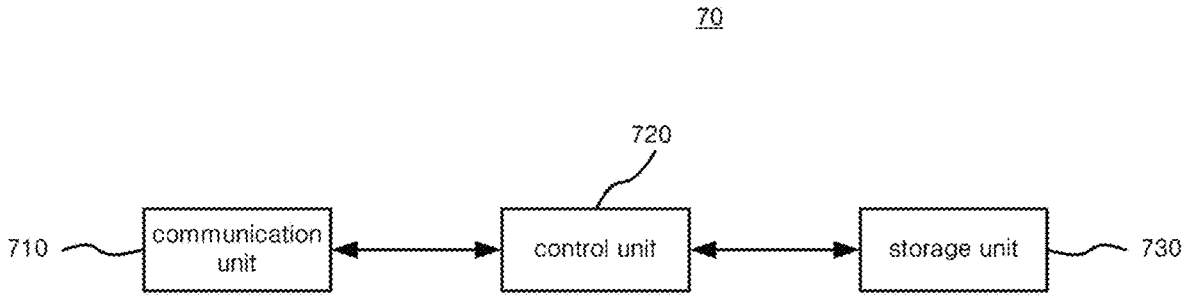
FIG. 3 is a diagram schematically illustrating a schematic configuration of a management server according to an exemplary embodiment of the present invention.

FIG. 3 is a diagram illustrating a schematic configuration of a management server 70 according to an exemplary embodiment of the present invention.

Referring to FIG. 3, the management server 70 may include a communication unit 710, a control unit 720, and a storage unit 730. Hereinafter, the function will be described in detail for each component.

The communication unit 710 may be a module that performs communication with the access point 60 and the weather server 80. For example, the communication unit 710 may include the long-range communication module implemented in a wired and wireless scheme, but the present invention is not limited thereto.

As described above, the communication unit 710 may receive the indoor temperature and humidity information measured by the temperature/humidity sensor 30, and receive the weather information of the target zone 10 provided from the weather server 80.

The storage unit 720 may include a memory and a processor. The memory may be a volatile and/or non-volatile memory, and may store instructions or data related to at least one other component of the management server 70. A processor may include one or more of a central processing unit (CPU), an application processor, or a communication processor.

The control unit 720 may control the communication unit 710, and generate the driving control signal of the air conditioner 20. The driving control signal may be generated on the basis of the indoor temperature and humidity information of the target zone 10 and the weather information of the target zone 10. In order to generate the driving control signal, the control unit 720 may calculate processing information using the information. The control unit 720 may generate the processing information in real time at the control time point of controlling the air conditioner 20, or generate the processing information before the control time point. Here, the control time point may correspond to a prediction time point of the amount of temperature change of the target zone 10.

The storage unit 730 may store various information related to the driving control of the air conditioner 20.

On the other hand, as described later, the amount of temperature change in the target area 10 may be predicted to generate the driving control signal. That is, the management server 70 may correspond to a device for predicting the amount of temperature change in the target area 10.

Hereinafter, a concept of a heat feature of the target zone 10, which affects the indoor temperature of the target zone 10 is first described, and in addition, an exemplary embodiment of controlling the driving of the air conditioner 20 by predicting the amount of temperature change of the target zone 10 will be described.

1. Thermal Feature of Target Zone 10

The thermal feature of the target zone 10 may be defined as an influence of internal and external environmental changes in the target zone 10 on a change in the indoor temperature of the target zone 10. The thermal feature of the target zone 10 may be generally different from the thermal features of other zones.

The thermal feature of the target zone 10 may be defined by a plurality of thermal feature parameters. According to the exemplary embodiment, the plurality of thermal feature parameters may include at least one of sunlight, a human body, a power consumption device, an acupuncture, ventilation, and a wall.

The sunlight is a light that is naturally reflected in the target zone 10 through windows provided in the target zone 10 without the user's intention. As the inflow of sunlight (i.e., solar radiation) to the target zone 10 increases, the indoor temperature of the target zone 10 may increase.

On the other hand, the inflow of the sunlight may be related to the cloud quantity. As the cloud quantity increases, the inflow of the sunlight may decrease, and as the cloud quantity decreases, the inflow of the sunlight may increase.

For example, the cloud quantity may be expressed in nine levels. On a very clear day, the cloud quantity is at level 0 (i.e., the minimum of cloud quantity) and the inflow of the sunlight is the maximum. In addition, for a very cloudy day, the cloud quantity is at level 8 (i.e., the maximum of cloud quantity) and the inflow of the sunlight is minimal.

The human body as a user positioned in the target zone 10 is a natural heating element. As the number of users positioned in the target zone 10 increases, the indoor temperature of the target zone 10 may increase.

The power consumption device is an electric/electronic device using power in order to perform a specific operation, and heat is emitted at the time of driving the power consumption device. For example, the power consumption device may be a lighting device, a personal computer (PC), a refrigerator, a water purifier, a TV, a humidifier, an air purifier, a dishwasher, etc. At this time, the air conditioner 20 is defined to be excluded from the power consumption device.

In particular, the lighting device is a device that emits light into the target zone 10 by the user's intention, and a somewhat large amount of heat may be released from the lighting device when light is emitted.

On the other hand, the power consumption device such as the refrigerator, the water purifier, etc. is not turned off in the target zone 10, but continuously turned on to release the heat. Therefore, the power consumption device that is continuously turned on is defined as a "base power consumption device", and a power consumption device which is turned on only during a specific time interval (e.g., an activity time of the target zone 10 to be described below), and turned off during a time interval other than the specific time interval is defined as a "non-base power consumption device".

The air infiltration is an outdoor air which flows into the target zone 10 through a gap of a window or a door. That is, the air infiltration is an outdoor air which naturally flows into the target zone 10 without the user's intention. As an example, in the case of the summer season, as a larger amount of air infiltration flows in, the indoor temperature of the target zone 10 may increase, and in the case of the winter season, as the larger amount of air flows in, the indoor temperature of the target zone 10 may decrease.

The ventilation is an outdoor air which flows into the target zone 10 by an opened window, driving of the ventilation device, etc. That is, the ventilation may be an air exchange between the indoor air and the outdoor air in the target zone 10. Similar to the air infiltration, in the case of the summer season, as more ventilation infiltration is performed, the indoor temperature of the target zone 10 may increase, and in the case of the winter season, as more ventilation is performed, the indoor temperature of the target zone 10 may decrease.

A wall structure includes the door, the window, a wall, etc. Internal heat of the target zone 10 may be leaked to the outside of the target zone 10 by a scheme such as radiation/convection/conduction through the wall structure, and external door of the target zone 10 may flow into the target zone 10 by the radiation/convection/conduction through the wall structure.

Meanwhile, the target zone 10 may be a zone where a specific activity is performed. As an example, the target zone 10 may be an office where an office activity is performed, a cafe and a restaurant where a service activity is performed. Further, an activity schedule or predetermined activity hours are set in the target zone 10. As an example, office hours may be set in the office, and service hours may be set in the cafe, the restaurant, etc. The activity hours may be defined to further include hours of preparing for the activity.

At this time, when the activity time of the target zone 10 is terminated, all users who perform the activity in the target zone 10 may go out of the target zone 10, and the non-base power consumption device, especially, the lighting device may be turned off, and the ventilation may not be performed. In addition, in the late-night hours, the sunlight is not introduced into the target zone 10, and all heat stored in the wall structure may be released due to a thermal inertia of the wall structure.

That is, the indoor temperature of the target zone 10 at the late night time may not be affected by at least one of heat by the sunlight passing through the target zone 10, the heat released from the human body located in the target zone 10, heat released from the non-base power consumption device, and heat generated by introduction of the outdoor air into the target zone due to the ventilation. However, the indoor temperature of the target zone 10 at the late night time may be affected by heat related by the driving of the base power consumption device, heat generated by the introduction of the outdoor air due to the air infiltration, and heat related to the wall structure.

In other words, the base power consumption device, the air infiltration, and the wall structure may be defined as a base thermal feature parameter among the thermal feature parameters, and the base thermal feature parameter may continuously affect the indoor temperature of the target zone 10 in all time zones. Further, the sunlight, the human body, the non-base power consumption device, and the ventilation may be defined as non-base thermal feature parameters among the thermal feature parameters, and the non-base thermal feature parameter may not affect the indoor temperature of the target zone 10 at the late night time.

2. Driving Control of Air Conditioner 20 on the Basis of Prediction of Amount of Temperature Change Amount in Target Zone 10

Figure 4:
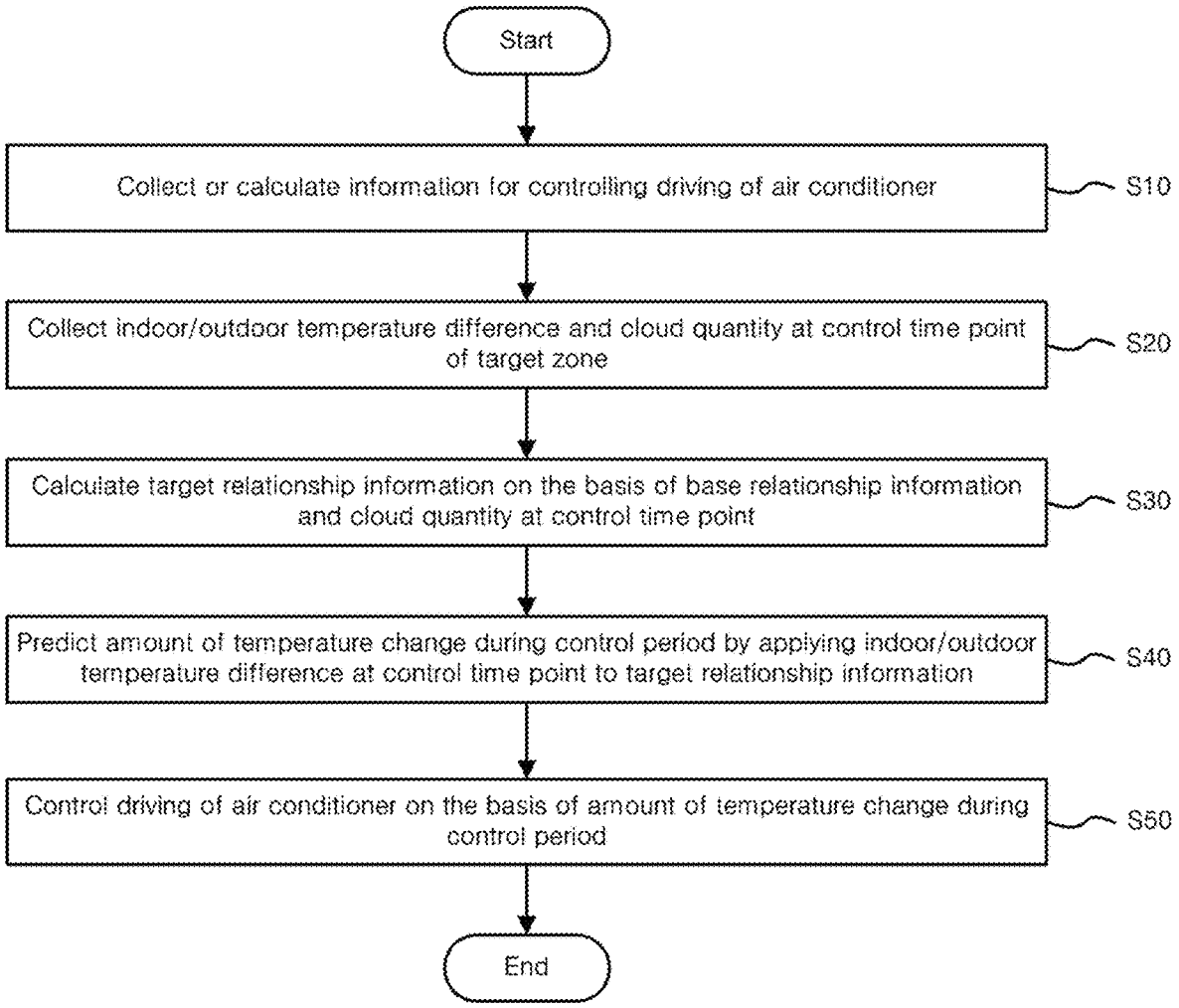
FIG. 4 is a diagram illustrating an overall flowchart of a method for controlling driving of an air conditioner according to an exemplary embodiment of the present invention.

FIG. 4 is a diagram illustrating an overall flowchart of a method for controlling driving of an air conditioner according to an exemplary embodiment of the present invention.

The air conditioner driving control method may be performed by the management server 70. Hereinafter, a process performed for each step will be described in detail.

First, in step S10, information for the control of the driving of the air conditioner 20 may be collected or calculated.

According to the exemplary embodiment, the information for controlling the driving may include collection information and calculation information. The collection information may include base information and intermediate information, and the calculation information may include base relationship information and intermediate relationship information.

The base information may be information on an amount of temperature change of the target zone 10 according to an indoor/outdoor temperature difference in the target zone 10 in a predetermined late time interval.

The indoor/outdoor temperature difference in the target zone 10 may correspond to a subtraction value ($T_o$-$T_i$) of the outdoor temperature of the target zone 10 and the indoor temperature of the target zone 10. In this case, the outdoor temperature of the target zone 10 may be collected from the weather server 80, and the indoor temperature of the target zone 10 may be measured by the temperature/humidity sensor 30.

As described above, the indoor temperature of the target zone 10 may be measured by the temperature/humidity sensor 30. In this case, when a plurality of temperature/humidity sensors 30 is installed in the target zone 10, the indoor temperature of the target zone 10 may be an average value of the indoor temperatures measured by the plurality of respective temperature/humidity sensors 30.

The amount of temperature change of the target zone 10 may be defined as a amount of temperature change per unit time in the target zone 10. As an example, the unit time may be 1 hour, but the present invention is not limited thereto.

The late night time section may be set on the basis of at least one activity time (i.e. activity schedule information) of the target zone 10, a sunrise time point, and a sunset time point in the target zone 10.

According to the exemplary embodiment, the late night time section may be a time interval between a first time point and a second time point. The second time point may come after the first time point. In this case, the first time point may correspond to a later time point of an end time point of the activity time of the target zone 10 and the sunset time point in the target zone 10, and the second time point may correspond to an earlier time point of a start time point of the activity time of the target zone 10 and the sunrise time point in the target zone 10.

As an example, when the target zone 10 is the office, the activity time of the office is 9:00 to 18:00, the sunset time point is 19:50, and the sunrise time point (i.e., a sunrise time point of a next day) is 5:10, the first time point may be 19:50 (the sunset time point) and the second time point may be 5:10 (the sunrise time point). As another example, when the target zone 10 is the café (coffee shop), the activity time of the cafe is 7:00 to 20:00, the sunset time point is 17:31, and the sunrise time point is 7:50, the first time point may be 20:00 (the end time point of the activity time) and the second time point may be 7:00 (the start time point of the activity time).

Moreover, the late night time section may be a time interval in which a predetermined elapsed after the activity time of the target zone 10 ends.

The late night time section may start at the time point when a predetermined time elapsed after the first time point. In this case, all heat stored in the wall structure may be released at a predetermined time. As an example, a length of the predetermined time may be 40 minutes, but the present invention is not limited thereto.

Base information may be collected at a predetermined cycle in the late night time section. As an example, when a length of the late night time section is 1 hour, the base information may be collected per 10 minutes.

The base information may be collected in the late night time section of each of one or more days before the control time point. That is, a plurality of base information may be collected at at least one day before the control time point. In this case, at least one day may include a target day including the control time point. That is, the base information may be collected even in the late night time section of the target day. In other words, the at least one day may be a day earlier than the control time point. At least one day may be set as a day just before the control time point. As an example, at least one day may be "10 days", but the present invention is not limited thereto.

Meanwhile, the base information may include off base information and on base information.

The off base information may be information on an amount of temperature change of the target zone 10 according to the indoor/outdoor temperature difference in the target zone 10 when the air conditioner 20 is turned off in the late night time section.

The on base information may be information on the amount of temperature change of the target zone 10 according to the indoor/outdoor temperature difference in the target zone 10 when the air conditioner 20 is turned on in the late night time section. In this case, in order to collect the base information, the air conditioner 20 may be turned on at a predetermined default desired temperature. As an example, the default desired temperature may be a desired temperature (e.g., 24° C. in a cooling mode) of the air conditioner 20 used most, but the present invention is not limited thereto.

At least one day when the off base information is collected and at least one day when the on base information is collected may be different from each other. That is, at the day when the off base information is collected, the on base information may not be collected, and at the day when the on base information is collected, the offset base information may not be collected.

For example, the base information as information collected in the late night time section may be information that does not reflect an influence of the non-base thermal feature parameter (i.e., the human body, the non-base power consumption device, and the ventilation) for the indoor temperature in the target zone 10, and reflects only an influence of the base thermal feature parameter (i.e., the base power consumption device, the air infiltration, and the wall structure). That is, the base information may be information on a unique thermal feature of the target zone 10.

The base relationship information may be defined as relationship information between the indoor/outdoor temperature difference of the target zone 10 and the amount of temperature change of the target zone 10 at the late night time. The base relationship information may be set by the plurality of base information.

Meanwhile, similarly to the above description, the base relationship information may include off base relationship information and on base relationship information. The off base relationship information may be relationship information between the indoor/outdoor temperature difference of the target zone 10 and the amount of temperature change of the target zone 10 when the air conditioner 20 is turned off at the late night time. The on base relationship information may be relationship information between the indoor/outdoor temperature difference of the target zone 10 and the amount of temperature change of the target zone 10 when the air conditioner 20 is turned on at the late night time.

According to the exemplary embodiment, the base relationship information may be expressed as a base relationship function equation corresponding to a trend line for a plurality of base information. According to the exemplary embodiment, the trend line may be a polynomial trend line, and in particular, may be a secondary polynomial trend line. That is, the base relationship information may correspond to a base relationship polynomial function equation that outputs the amount of temperature change of the target zone 10 by setting the indoor/outdoor temperature difference as a variable. In this case, the base relationship information may be separately set in the cooling mode and a heating mode of the air conditioner 20.

Figure 5A:
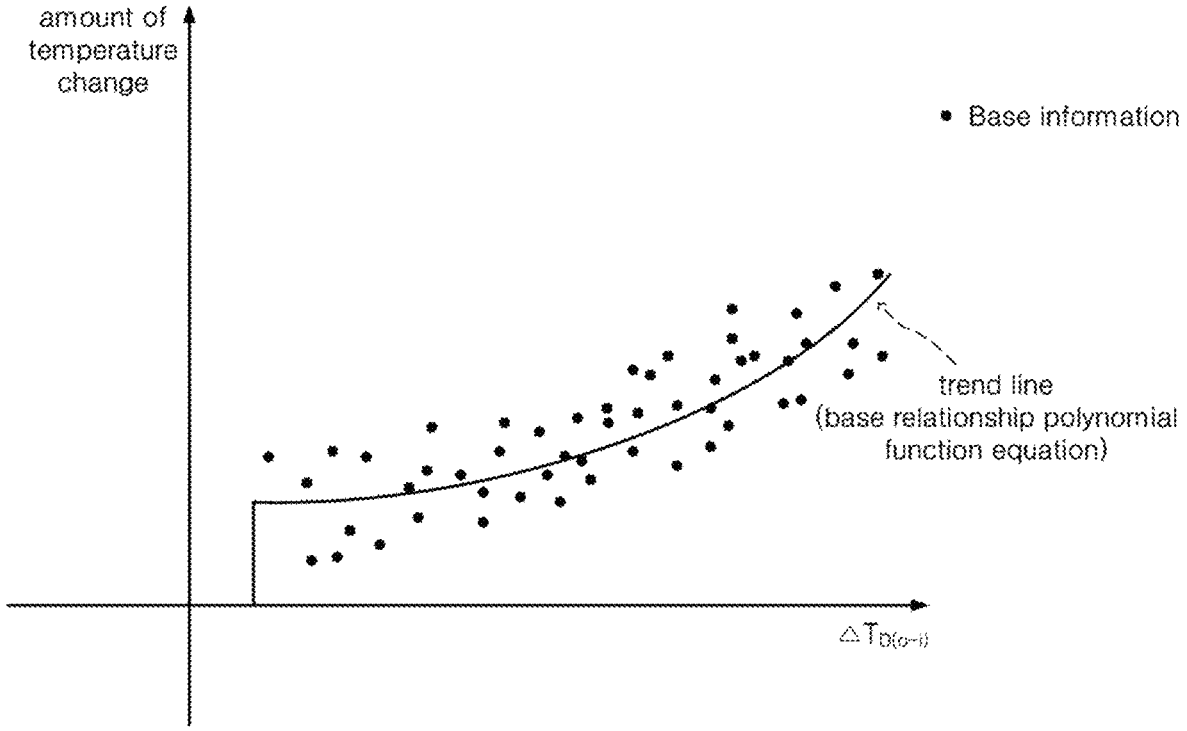
FIGS. 5A, 5B, 6, and 7 are diagrams for describing a concept of a relation polynomial function equation for a method for controlling driving of an air conditioner according to an exemplary embodiment of the present invention.
Figure 5B:
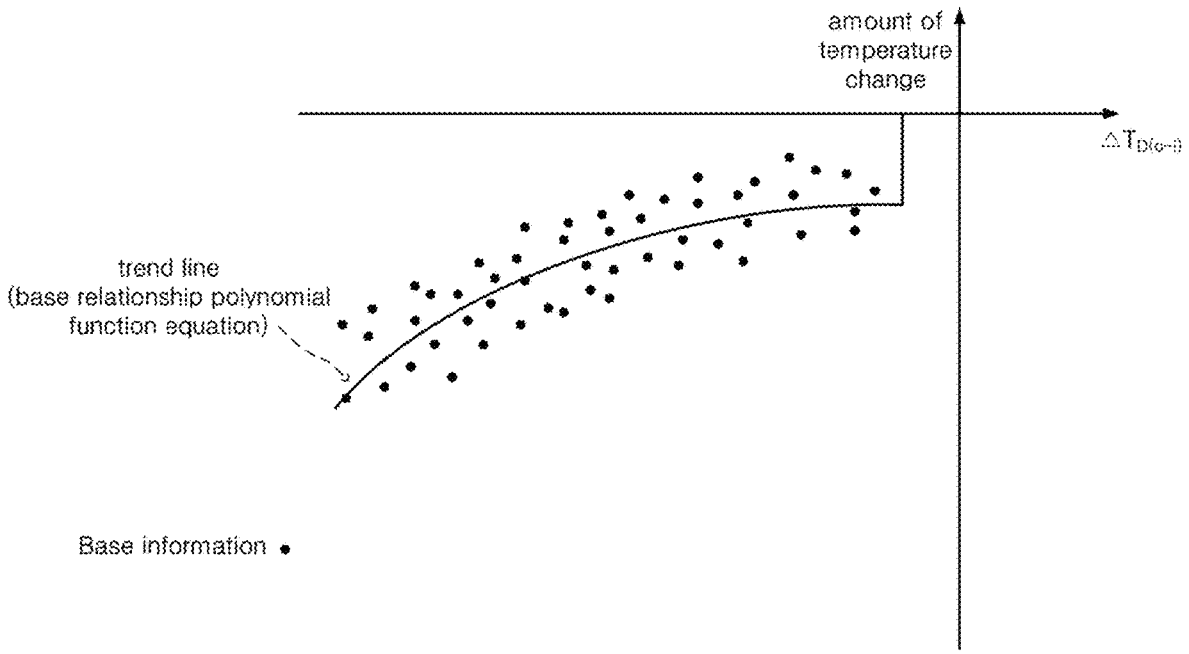

FIGS. 5A and 5B illustrate an example of a trend line on the basis of the plurality of base information, i.e., the base relationship polynomial function equation. In this case, FIG. 5A illustrates the base relationship polynomial function equation for the cooling mode and FIG. 5B illustrates the base relationship polynomial function equation for the heating mode.

According to the exemplary embodiment, in each of the cooling mode and the heating mode, a function value of the base relationship polynomial equation may be expressed as in Equation 1 below.

$$f(\Delta T_{D(o-i)})=a\Delta T_{D(o-i)}^{2}+b\Delta T_{D(o-i)}+c \quad \text{[Equation 1]}$$

wherein, $\Delta T_{D(o-i)}$ represents the indoor/outdoor temperature difference in the target zone 10, $f(\Delta T_{D(o-i)})$ represents the amount of temperature change of the target zone a and b represent a coefficient of a variable term defined by the thermal feature of the target zone 10, and c represents a constant term defined by the thermal feature parameter of the target zone 10.

For example, the base relationship information may be relationship information between the indoor/outdoor temperature difference in the target zone 10 and the amount of temperature change of the target zone 10 to which the base thermal feature parameters of the target zone 10 are applied, and may include off base relationship information when the air conditioner 20 is turned off and on base relationship information when the air conditioner 20 is turned on. In this case, the influence related to the non-base thermal feature parameter is not included in the base relationship information. That is, the base relationship information may be relationship information to which the unique thermal feature of the target zone 10 is reflected.

The Intermediate information may be information on the amount of temperature change of the target zone 10 according to the indoor/outdoor temperature difference in the target zone 10 in the activity time.

Meanwhile, similarly to the above description, the intermediate information may include off intermediate information and on intermediate information. The off intermediate information may be information on the amount of temperature change of the target zone according to the indoor/outdoor temperature difference in the target zone 10 when the air conditioner 20 is turned off at the activity time. The on intermediate information may be information on the amount of temperature change of the target zone 10 according to the indoor/outdoor temperature difference in the target zone 10 when the air conditioner is turned on at the activity time. In this case, in order to collect the on intermediate information, the air conditioner 20 may be turned on at a predetermined default desired temperature. A day when the off intermediate information is collected and a day when the on intermediate information is collected may be different from each other.

The intermediate information may be collected in a specific time interval of the activity time at the day before the control time point. The previous day may be at least one. That is, at least one intermediate information may be collected at the day before the control time point. In this case, the previous day may also include a target day including the control time point. That is, the base information may be collected even at the activity time of the target day. In other words, the previous day may be a day earlier than the control time point.

According to the exemplary embodiment, each of a plurality of intermediate information may include a plurality of first intermediate information and a plurality of second intermediate information.

Each of the plurality of first intermediate information may be information on the amount of temperature change of the target zone 10 according to the indoor/outdoor temperature difference in the target zone 10 in the activity time at a day when the cloud quantity is maximum before the control time point. Here, "the maximum cloud quantity" may correspond to "very cloudy day", "cloud quantity at level 8", or "minimum sunlight amount".

Each of the plurality of second intermediate information may be information on the amount of temperature change of the target zone 10 according to the indoor/outdoor temperature difference in the target zone 10 in the activity time at a day when the cloud quantity is minimal before the control time point. Here, "the minimum cloud quantity" may correspond to "very cloudy day", "cloud quantity at 0", or "minimum sunlight amount".

For example, the intermediate information as information collected at the activity time may be information that reflects an influence of the base thermal feature parameter (i.e., the base power consumption device, the air infiltration, and the wall structure) and the non-base thermal feature parameter (i.e., the sunlight, the human body, the non-base power consumption device, and the ventilation) for the indoor temperature in the target zone 10.

In particular, since the first intermediate information is information collected at the activity time of the very cloudy day, the influence of the sunlight is not reflected to the first intermediate information. That is, the first intermediate information may be information to which the influence on the human body, the power consumption device, the air infiltration, the ventilation, and the wall structure other than the sunlight is reflected. In addition, since the second intermediate information is information collected at the activity time of the very clean day, the influence of sunlight of the maximum inflow amount is reflected to the second intermediate information. That is, the second intermediate information may be the information to which the influence on the sunlight of the maximum inflow amount, the human body, the power consumption device, the air infiltration, the ventilation, and the wall structure is reflected.

The intermediate relationship information may be defined as relationship information between the indoor/outdoor temperature difference of the target zone 10 and the amount of temperature change of the target zone 10 at the activity time. The intermediate relationship information may be set by the plurality of intermediate information. The intermediate relationship information may be separately set in the cooling mode and the heating mode of the air conditioner 20.

Meanwhile, similarly to the above description, the intermediate relationship information may include off intermediate relationship information and on intermediate relationship information. The off intermediate relationship information may be relationship information between the indoor/outdoor temperature difference of the target zone 10 and the amount of temperature change of the target zone 10 when the air conditioner 20 is turned off at the activity time. The on intermediate relationship information may be relationship information between the indoor/outdoor temperature difference of the target zone 10 and the amount of temperature change of the target zone 10 when the air conditioner 20 is turned on at the activity time.

According to the exemplary embodiment, the intermediate relationship information may be set by reflecting the intermediate information to the base relationship information. Thus, intermediate relationship information may also be expressed as an intermediate relationship polynomial function equation.

According to the exemplary embodiment, the intermediate relationship polynomial function equation may be set by changing a constant term of the base relationship polynomial function equation.

Specifically, the intermediate information may be expressed as a 2-dimensional coordinate value, that is, the indoor/outdoor temperature difference or the amount of temperature change). At this time, an output value of the base relationship polynomial function equation may be calculated by substituting "indoor/outdoor temperature difference" among the coordinate values of the intermediate information into the base relationship polynomial function equation, a difference value of the amount of temperature change may be calculated by subtracting the "amount of temperature change" among the coordinate values of the intermediate information and the output value of the base relationship polynomial function equation, and the intermediate relationship polynomial function equation may be calculated by adding the difference value of the amount of temperature change to the constant term of the base relationship polynomial function equation. In other words, the base relationship polynomial function equation and the intermediate relationship polynomial function equation may have a relationship in which constant terms are different and variable terms are the same. The intermediate relationship polynomial function equation may also be expressed by Equation 1 described above.

Meanwhile, when there is a plurality of intermediate information, the computation process is performed for each of the plurality of intermediate information to calculate a difference value of a plurality of amount of temperature changes, and an average value of the difference values of the plurality of amount of temperature changes is added to the constant term of the base relationship polynomial function equation to calculate the intermediate relationship polynomial function equation.

According to the exemplary embodiment, the intermediate relationship information may include first and second intermediate relationship information.

The first intermediate relationship information may be relationship information between the indoor/outdoor temperature difference of the target zone 10 and the amount of temperature change of the target zone 10 at the activity time when the cloud quantity is the maximum (the sunlight inflow amount is minimal). The first intermediate relationship information may be set by reflecting the first intermediate information to the base relationship information. In particular, the first intermediate relationship information may correspond to the first intermediate relationship polynomial function equation set by changing the constant term of the base relationship polynomial function equation using the first intermediate information.

In particular, as described above, the human body, the power consumption device, the air infiltration, the ventilation, and the wall structure are reflected to the first intermediate information, but the influence by the sunlight is not reflected, so the first intermediate relationship information may be the relationship information between the indoor/outdoor temperature difference in the target zone 10 to which the human body, the power consumption device, the air infiltration, the ventilation, and the wall structure are reflected, and the amount of temperature change of the target zone 10.

The second intermediate relationship information may be relationship information between the indoor/outdoor temperature difference of the target zone 10 and the amount of temperature change of the target zone 10 at the activity time when the cloud quantity is minimal (the sunlight inflow amount is the maximum). The second intermediate relationship information may be set by reflecting the second intermediate information to the base relationship information. The second intermediate relationship information may correspond to the second intermediate relationship polynomial function equation set by changing the constant term of the base relationship polynomial function equation using the second intermediate information.

In particular, as described above, since the second intermediate information is information to which the influence by the maximum inflow amount of sunlight is reflected jointly with the human body, the power consumption device, the air infiltration, the ventilation, and the wall structure, the second intermediate relationship information may be relationship information to which the maximum inflow amount of sunlight, the human body, the power consumption device, the air infiltration, the ventilation, and the wall structure are all reflected.

For example, the first and second intermediate relationship information is relationship information derived from the base relationship information, and the first intermediate relationship information may be relationship information to which the human body, the non-base power consumption device, and the ventilation are further reflected in the base relationship information, and the second interim relationship information may be a relationship information to which the maximum inflow amount of sunlight is further reflected in the first intermediate relationship information.

Referring back to FIG. 4, in step S20, the indoor/outdoor temperature difference and the cloud quantity at the control time point may be collected.

As described above, the control time point as the time included in the target day may be a prediction time point of predicting the amount of temperature change of the target zone 10. The indoor/outdoor temperature difference at the control time point may be calculated on the basis of the indoor temperature at the time measured by the temperature/humidity sensor 30 and the outdoor temperature at the control time point collected by the weather server 80. The cloud quantity at the control time point may be collected by the weather server 80.

In step S30, target relationship information may be calculated by correcting the base relationship information on the basis of the cloud quantity at the control time point.

Here, the target relationship information as relation information used for predicting the amount of temperature change during a control period in the target zone 10 after the control time point may be the relationship information between the indoor/outdoor temperature difference of the target zone 10 and the amount of temperature change of the target zone at the control time point.

Meanwhile, similar to the above description, the target relationship information may include off target relationship information and on target relationship information. The off target relationship information may be relationship information between the indoor/outdoor temperature difference of the target zone 10 and the amount of temperature change of the target zone 10 when the air conditioner 20 is turned off at the control time point.

The on target relationship information may be relationship information between the indoor/outdoor temperature difference of the target zone 10 and the amount of temperature change of the target zone 10 when the air conditioner 20 is turned on at the control time point.

Meanwhile, the target relationship information may be set for each desired temperature of the air conditioner 20. That is, as described above, the management server 70 may calculate each target relationship information for a default desired temperature. However, the air conditioner 20 may also be turned on at another desired temperature other than the default desired temperature at the control time point. In this case, the management server 70 may estimate the target relationship information for another desired temperature on the basis of the target relationship information for the default desired temperature.

According to the exemplary embodiment, the control time point may be a start time point of the control period and a length of the control period may be a unit time (e.g., 1 hour). The control period may correspond to a period of predicting the amount of temperature change of the target zone 10.

According to the exemplary embodiment, the base relationship information may correspond to the base relationship polynomial function equation, and in step S30, a target relationship polynomial function equation corresponding to the target relationship information may be calculated by changing a constant value of the base relationship polynomial function equation on the basis of the cloud quantity at the control time point.

Further, according to another exemplary embodiment, the target relationship information may be calculated by reflecting the cloud quantity at the control time point to the first and second intermediate relationship information derived from the base relationship information.

As described above, the first intermediate relationship information may be relationship information to which the thermal feature parameters of the human body, the power consumption device, the air infiltration, the ventilation, and the wall structure are reflected except for the sunlight, and the second intermediate relationship information may be relationship information to which all thermal feature parameters of the maximum inflow amount of sunlight, the human body, the power consumption device, the air infiltration, the ventilation, and the wall structure are reflected. Therefore, in step S30, the cloud quantity at the control time point related to the sunlight is reflected to the first intermediate relationship information and the second intermediate relationship information to calculate the target relationship information for predicting the amount of temperature change during the control period in the target zone 10.

According to the exemplary embodiment, similar to the above description, the target relationship information may correspond to the target relationship polynomial function equation. In this case, the target relationship polynomial function equation may be set by changing the constant term of the base relationship polynomial function equation on the basis of the first intermediate relationship polynomial function equation, the second intermediate relationship polynomial function equation, and the cloud quantity at the control time point.

Specifically, the target relationship polynomial function equation may have a relationship in which the constant term is different from and the variable term is the same as each of the base relationship polynomial function equation, the first intermediate relationship polynomial function equation, and the second intermediate relationship polynomial function equation.

Figure 6:
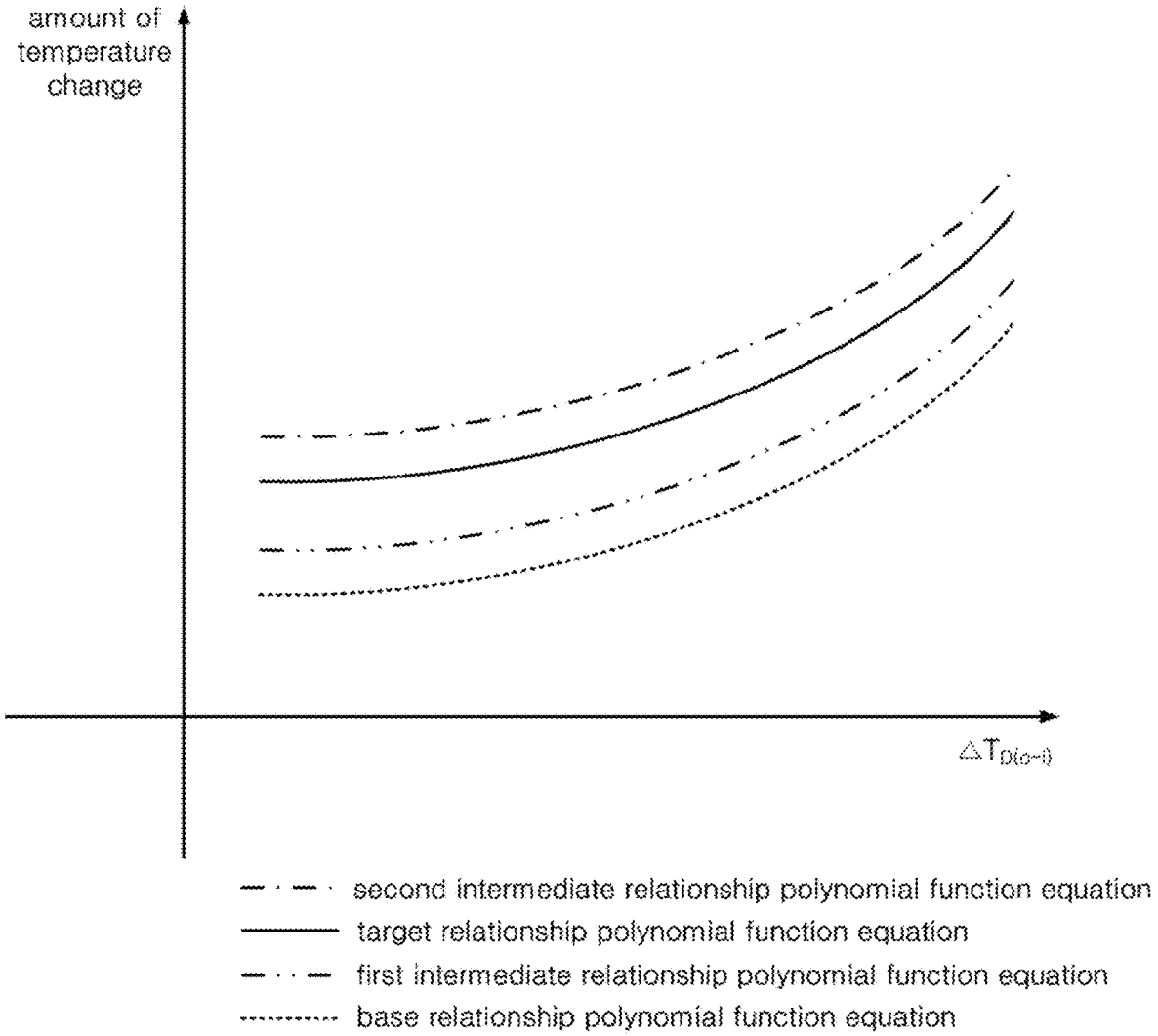

FIG. 6 illustrates the base relationship polynomial function equation, the first intermediate relationship polynomial function equation, the second intermediate relationship polynomial function equation, and the target relationship polynomial function equation when the air conditioner 20 operates in the cooling mode according to an exemplary embodiment of the present invention.

Referring to FIG. 6, the base relationship polynomial function equation, the first intermediate relationship polynomial function, the second intermediate relationship polynomial function equation, and the target relationship polynomial function equation have the relationship in which the constant term is different from and the variable term is the same as each other.

Further, referring to FIG. 6, the constant term of the target relationship polynomial function equation may be a value between the constant term of the first intermediate relationship polynomial function equation and the second intermediate relationship polynomial function equation, and the value therebetween may be estimated on the basis of the cloud quantity at the control time point. Here, as the cloud quantity at the control time point is the larger, the target relationship polynomial function equation is headed to the first intermediate relationship polynomial function equation and the as the loud quantity at the control time point is the smaller, the target relationship polynomial function equation is headed to the second intermediate relationship polynomial function equation.

As an example, when the cloud quantity at the control time point is at level 0, the target relationship polynomial function equation is the same as the second intermediate relationship polynomial function equation. Further, when the cloud quantity at the control time point is at level 8, the target relationship polynomial function equation is the same as the first intermediate relationship polynomial function equation. Further, when the cloud quantity at the control time point is at level 5, the target relationship polynomial function equation is present in the middle of the first intermediate relationship polynomial function equation and the second intermediate relationship polynomial function equation, and the constant term of the target relationship polynomial function equation corresponds to an average value of the constant terms of the first intermediate relationship polynomial function equation and the second intermediate relationship polynomial function equation.

Meanwhile, the on target relationship information may be set for each desired temperature of the air conditioner 20. That is, the management server 70 may calculate each target relationship information for the default desired temperature, but the air conditioner 20 may also be turned on at another desired temperature other than the default desired temperature. In this case, the management server 70 may estimate the on target relationship information for the another desired temperature on the basis of the on target relationship information for the default desired temperature.

Figure 7:
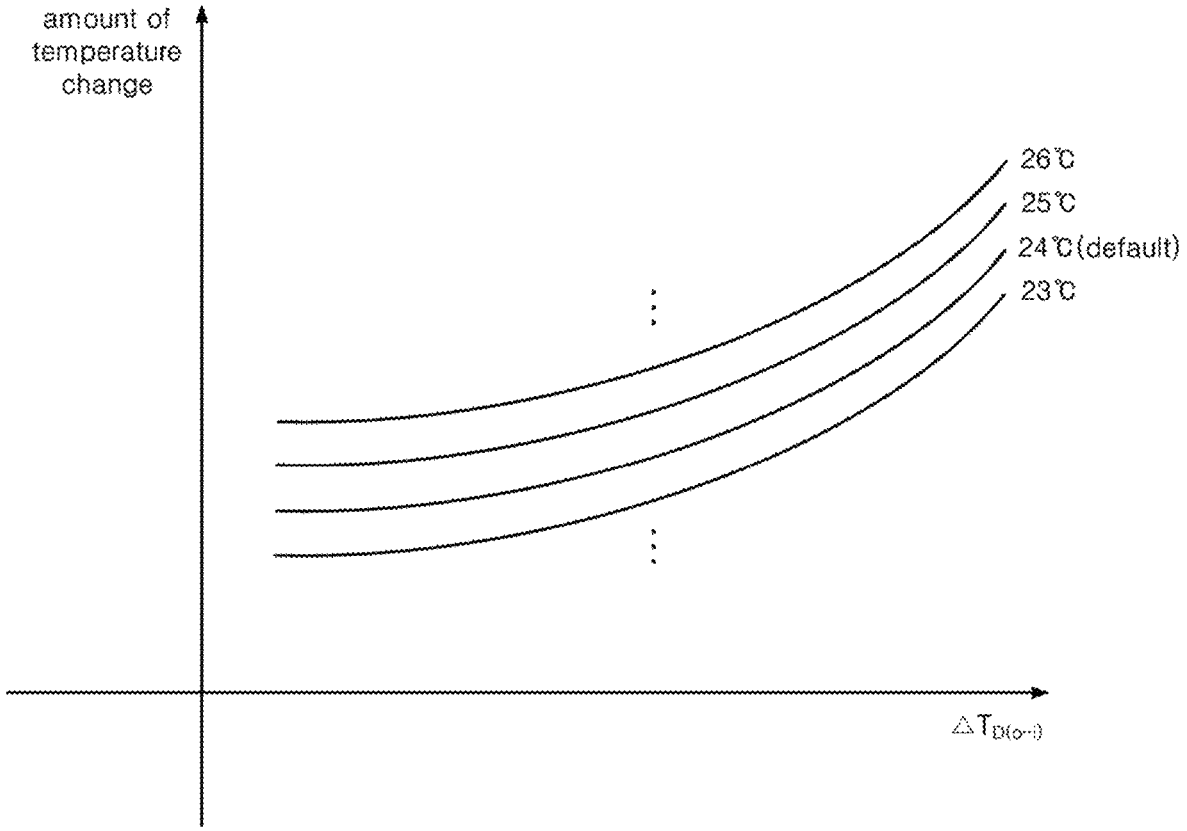

In FIG. 7, a concept of estimating the target relationship polynomial function equation for each desired temperature on the basis of the target relationship polynomial function equation for the default desired temperature is illustrated. Referring to FIG. 7, the target relationship polynomial function equation for each desired temperature may have a relationship in which the constant term is changed in the target relationship information for the default desired temperature.

For example, the base relationship information may be information to which the base thermal feature parameter is reflected, and the first intermediate relationship information may be relationship information to which the thermal feature parameters except for the sunlight among the plurality of thermal feature parameters are reflected, the second intermediate relationship information may be relationship information to which all thermal feature parameters including the maximum inflow amount of sunlight are reflected, and the target relationship information may be relationship information to which thermal feature parameters at the control time point on the basis of the first and second intermediate relationship information, and the cloud quantity at the control time point are reflected. In addition, each relationship information may include the off relationship information and the on relationship information.

Referring back to FIG. 4, in step S40, the indoor/outdoor temperature difference at the control time point in the target zone 10 is applied to the target relationship information to predict the amount of temperature change during the control period in the target zone 10.

In this case, the amount of temperature change during the control period in the target zone 10 may include a first amount of temperature change and a second amount of temperature change. The first amount of temperature change may be an amount of temperature change of the target zone 10 when the air conditioner 20 is turned off during the control period, and the second amount of temperature change may be an amount of temperature change of the target zone 10 when the air conditioner 20 is turned on during the control period.

According to the exemplary embodiment, when the target relationship information corresponds to the target relationship polynomial function equation, the amount of temperature change during the control period may be calculated by substituting the indoor/outdoor temperature difference at the control time point as a variable of the target relationship polynomial function equation in step S40.

In summary, the management server 70 according to an exemplary embodiment of the present invention may i) calculate the base relationship information to which a unique thermal feature parameter (i.e., a base thermal feature parameter) of the target zone 10 is reflected, ii) calculates the first intermediate relationship information to which the thermal feature parameter of the target zone 10 except for the sunlight is reflected on the basis of the first intermediate information and the base relationship information, iii) calculates the second intermediate relationship information to which all thermal feature parameters of the target zone 10 are reflected on the basis of the second intermediate information and the base relationship information, iv) calculates the target relationship information on the basis of the first and second intermediate relationship information and the cloud quantity at the control time point, and v) calculate the amount of temperature change of the target zone 10 during the control period on the basis of the target relationship information, and the indoor/outdoor amount of temperature change at the control time point. In this case, since all thermal feature parameters at the control time point are reflected to the target relationship information, the thermal feature of the target zone 10 may be shown. Therefore, the amount of temperature change during the control period in the target zone 10 may be accurately predicted by using the target relationship information.

Last, in step S50, driving of the air conditioner 20 may be controlled on the basis of the amount of temperature change during the control period. That is, in step S50, the driving of the air conditioner 20 may be controlled on the basis of the first and second amount of temperature changes during the control period. In this case, the driving control of the air conditioner 20 may be a change of a driving state of the air conditioner 20 (that is, a change of turn on/off of the air conditioner 20) and setting of a desired temperature of the air conditioner 20 when the air conditioner 20 is driven.

According to the exemplary embodiment, in step S50, the driving of the air conditioner 20 may be controlled on the basis of a predetermined comfortable temperature, and the amount of temperature change during the control period.

Here, the comfortable temperature may be defined as a felt temperature at which a user positioned in the target zone 10 feels comfortable. The comfortable temperature may also be set differently for each season, and set differently for each period included in the target day. A plurality of periods may be set on the basis of an operation schedule for the target zone 10. In this case, the comfortable temperature may include an off comfortable temperature which is a felt temperature at which the user feels comfortable when the air conditioner 20 is turned off and an on comfortable temperature which is a felt temperature at which the user feels comfortable when the air conditioner 20 is turned on.

Referring to the above-described contents, in step S50, a first process on the basis of the off comfortable temperature and the first amount of temperature change and a second process on the basis of the on comfortable temperature and the second amount of temperature change are performed to control the driving of the air conditioner 20.

Meanwhile, the air conditioner driving control method is a method for predicting the amount of temperature change of the target zone 10 by calculating the target relationship information by correcting the base relationship information according to the cloud quantity (i.e., sunlight). However, the present invention is not limited to the above-described contents. That is, in the air conditioner driving control method, the amount of temperature change of the target zone 10 may also be predicted by calculating the target relationship information by correcting the base relationship information according to the non-base thermal feature parameter (i.e., at least one of the human body, the non-base power consumption device, and the ventilation) other than the sunlight. Since this is similar to the above-described contents, a description of redundant contents is omitted.

Meanwhile, the contents described in FIGS. 4 to 6 may also be performed by the control module 40 other than the management server 70. In this case, the control module 40 may include a high-performance processor based control unit, and further include the second short-range communication module and the infrared communication module. The control module may acquire weather information of the target zone 10 from the weather server 80 through the access point 60 and the gateway 50, and acquire indoor temperature and humidity of the target zone 10 measured by the temperature/humidity sensor 30 through the gateway 50. Further, the temperature/humidity sensor 30 and the control module 40 may be built in the air conditioner 20. In this case, the control module 40 may also directly acquire the indoor temperature and humidity from the temperature/humidity sensor 30. Since the performance operation of the control module 40 is similar to the above description, a detailed description will be omitted.

Although it is described that all components of an embodiment of the present invention are combined with each other or are operated while being combined with each other, the present invention is not necessarily limited thereto, and at least one of all the components may be operated while being selectively combined with each other without departing from the scope of the present invention. Although each of all the components may be embodied as independent hardware, some or all of the components may be selectively combined to realize a computer program having a program module which performs some or all of functions of a combination of one or more hardware units. Code and code segments constituting the computer program can be easily reasoned by those of ordinary skill in the art. The computer program may be stored in a computer-readable medium, and an embodiment of the present invention may be implemented by reading and executing the computer program. Examples of the computer-readable medium storing the computer program include a magnetic recording medium, an optical recording medium, and a storage medium with a semiconductor recording element. The computer program for implementing the present invention includes a program module transmitted in real time via an external device.

While embodiments of the present invention have been particularly described, various changes or modifications may be made therein by general technical experts. It is therefore to be understood that such changes and modifications are included within the scope of the present invention unless they depart from the scope of the present invention.

What is claimed is:

1. A method for controlling an air conditioner installed in a target zone, which is performed by a processor apparatus, the method comprising:

receiving a plurality of indoor temperatures of the target zone during a late night time section at each of at least one day measured by a temperature sensor;

receiving a plurality of outdoor temperatures of the target zone during the late night time section at each of the at least one day provided by an external device;

generating a plurality of base information on the basis of the plurality of indoor temperatures and the plurality of outdoor temperatures, wherein the base information is information on an amount of temperature change of the target zone according to an indoor/outdoor temperature difference of the target zone;

calculating base relationship information between the indoor/outdoor temperature difference of the target zone and the amount of temperature change of the target zone on the basis of the plurality of base information;

generating a driving control signal for the air conditioner at a control time point that comes after the at least one day on the basis of the basic relationship information; and transmitting the driving control signal to the air conditioner, wherein the late night time section is set on the basis of at least one of activity time of the target zone, a sunrise time point, and a sunset time point.

2. The method of claim 1, wherein the late night time section is a time interval between a first time point and a second time point, wherein the first time point corresponds to a later time point of an end time point of the activity time of the target zone and the sunset time point, and wherein the second time point corresponds to an earlier time point of a start time point of the activity time of the target zone and the sunrise time point.

3. The method of claim 2, wherein the late night time section starts at a time point when a predetermined time has elapsed after the first time point.

4. The method of claim 1, wherein the base relationship information is expressed as a base relationship function equation corresponding to a trend line for the plurality of base information.

5. The method of claim 1, wherein the indoor temperature of the target zone during the late night time section is not influenced by a non-base thermal feature parameter, and wherein the non-base thermal feature parameter includes at least one of sunlight passing through the target zone, a human body positioned in the target zone, a power consumption device which is turned off during the late night time section, and an intentional outdoor inflow into the target zone.

6. The method of claim 1, wherein the generating the driving control signal on the basis of the basic relationship information comprises:

receiving a cloud quantity at the control time point provided by the external device;

calculating target relationship information by correcting the base relationship information on the basis of the cloud quantity; and generating the driving control signal on the basis of the target relationship information, wherein the target relationship information is relationship information between the indoor/outdoor temperature difference of the target zone and the amount of temperature change of the target zone at the control time point.

7. The method of claim 6, wherein the generating the driving control signal on the basis of the target relationship information further comprises:

receiving an indoor temperature of the target zone at the control time point measured by a temperature sensor;

receiving an outdoor temperature of the target zone at the control time point by the external device;

calculating an indoor/outdoor temperature difference of the target area at the control time point on the basis of the indoor temperature at the control time point and the outdoor temperature at the control time point;

predicting an amount of temperature change during a control period of the target zone by applying the indoor/outdoor temperature difference at the control time point to the target relationship information; and generating the driving control signal on the basis of the amount of temperature change during the control period, wherein the control period is included in the activity time of the target zone.

8. The method of claim 7, wherein, in the calculating of the target relationship information, the target relationship information is calculated on the basis of pre-calculated intermediate relationship information and the cloud quantity at the control time point, and the intermediate relationship information is set by reflecting pre-generated intermediate information to the base relationship information, wherein the intermediate relationship information includes first and second intermediate relationship information, wherein the first intermediate relationship information is relationship information between the indoor/outdoor temperature difference of the target zone and the amount of temperature change of the target zone at an activity time when the cloud quantity is maximum, and wherein the second intermediate relationship information is relationship information between the indoor/outdoor temperature difference of the target zone and the amount of temperature change of the target zone at an activity time when the cloud quantity is minimal.

9. The method of claim 8, wherein the intermediate information includes first and second intermediate information, wherein the first intermediate information is information on the amount of temperature change of the target zone according to the indoor/outdoor temperature difference of the target zone at the activity time when the cloud quantity is maximum before the control time point, wherein the second intermediate information is information on the amount of temperature change of the target zone according to the indoor/outdoor temperature difference of the target zone at the activity time when the cloud quantity is minimal before the control time point, and wherein the first intermediate relationship information is set by reflecting the first intermediate information to the base relationship information and the second intermediate relationship information is set by reflecting the second intermediate information to the base relationship information.

10. The method of claim 8, wherein the base relationship information corresponds to a base relationship polynomial function equation which outputs the amount of temperature change of the target zone by using the indoor/outdoor temperature difference of the target zone as a variable, wherein the first intermediate relationship information corresponds to a first intermediate relationship polynomial function equation set by changing a constant term of the base relationship polynomial function equation using the first intermediate information, and wherein the second intermediate relationship information corresponds to a second intermediate relationship polynomial function equation set by changing the constant term of the base relationship polynomial function equation using the second intermediate information.

11. The method of claim 10, wherein the target relationship information corresponds to a target relationship polynomial function equation set by changing the constant term of the base relationship polynomial function equation by using the first intermediate relationship polynomial function equation, the second intermediate relationship polynomial function equation, and the cloud quantity at the control time point, and wherein the constant term of the target relationship polynomial function equation is a value between the constant term of the first intermediate relationship polynomial function equation and the constant term of the second intermediate relationship polynomial function equation.

12. An apparatus for controlling an air conditioner installed in a target zone, the apparatus comprising:

a communicator;

a memory storing a computer-readable instruction; and a processor implemented to execute the instruction to:

receive, through the communicator, a plurality of indoor temperatures of the target zone during a late night time section at each of at least one day measured by a temperature sensor;

receive, through the communicator, a plurality of outdoor temperatures of the target zone during the late night time section at each of the at least one day provided by an external device;

generate a plurality of base information on the basis of the plurality of indoor temperatures and the plurality of outdoor temperatures, wherein the base information is information on an amount of temperature change of the target zone according to an indoor/outdoor temperature difference of the target zone;

calculate base relationship information between the indoor/outdoor temperature difference of a target zone and the amount of temperature change of the target zone on the basis of the plurality of base information;

generate a driving control signal for the air conditioner at a control time point that comes after the at least one day on the basis of the basic relationship information; and transmit, through the communicator, the driving control signal to the air conditioner, wherein the late night time section is set on the basis of at least one of activity time of the target zone, a sunrise time point, and a sunset time point.

* * * * *